United States Patent [19]

Jesson

[11] 4,036,033

[45] July 19, 1977

[54] PLURAL CAM TRACKS FOR ROCKABLE JACKS

[75] Inventor: Leslie William Digby Jesson, Leicester, England

[73] Assignee: The Bentley Engineering Company, Ltd., England

[21] Appl. No.: 591,648

[22] Filed: June 30, 1975

[30] Foreign Application Priority Data

July 11, 1974 United Kingdom ..... 30679/74

[51] Int. Cl.[2] ..... D04B 9/10; D04B 15/68

[52] U.S. Cl. ..... 66/14; 66/50 R

[58] Field of Search ..... 66/14, 50 R, 42 R

[56] References Cited

U.S. PATENT DOCUMENTS

| | | | |
|---|---|---|---|
| 2,210,075 | 8/1940 | Getaz | 66/50 R X |
| 3,046,760 | 7/1962 | Peberdy | 66/14 |
| 3,240,032 | 3/1966 | Carrotte | 66/50 R X |
| 3,678,710 | 7/1972 | Gostelow | 66/14 |

FOREIGN PATENT DOCUMENTS

| | | | |
|---|---|---|---|
| 930,805 | 7/1963 | United Kingdom | 66/14 |

*Primary Examiner*—Louis K. Rimrodt
*Assistant Examiner*—Andrew M. Falik
*Attorney, Agent, or Firm*—Robert E. Burns; Emmanuel J. Lobato; Bruce L. Adams

[57] ABSTRACT

A circular knitting machine with rockable jacks has cams for displacing butts of the jacks along tricks in a needle cylinder, and means for rocking the jacks to provide an interruption in a guide track for certain jacks so that their other butts project and to permit butts of jacks following another track to pass through the interruption.

11 Claims, 2 Drawing Figures

PLURAL CAM TRACKS FOR ROCKABLE JACKS

BACKGROUND OF THE INVENTION

The invention relates to circular knitting machinery and in particular to the arrangement of cams and jacks for patterning.

The Applicant' earlier British Pat. No. 844,602 (corresponding to U.S. Pat. No. 3,046,760 and West-German Pat. No. 1,155,209) describes opposed cylinder knitting machinery with double ended needles, needle receiving sliders, and mechanism for transferring needles as required from one cylinder to the other. That Specification is particularly concerned with the production of both links-links and float stitch or similar patterning in the same courses.

The patterning is produced using rocking jacks which have upper and lower butts and can be rocked by selectors controlled by pattern drums or by ramps placed in the tracks of butts for the jacks. The ramps are used to push all lower butts of the passing jacks into the tricks to enable them to be cammed out of the trick subsequently in a selective manner by the selectors. Using the selectors, jacks which advance in a stream can be split up to follow two paths, one group of jacks being guided after engaging the selectors by their lower butts and the other group being guided, after failing to engage the associated selectors, by their upper butts. The jacks guided by their lower butts can be subjected to a further selecting operation, optionally after having converged into a single path with other jacks previously guided by their upper butts, after passing a further ramp so as to provide a pair of separate jack paths.

Thus links-links and float stitch patterning can be combined by first making a links-links selection (by selecting jacks to place butts of associated sliders onto a transfer cam) and then making a float selection (by selecting jacks to be raised to place butts of associated sliders onto a raising cam, float stitches being formed by jacks which have not been raised) whilst keeping the jacks involved in transfer above those raised for knitting in the lower cylinder. The jacks involved in transfer can thus not become involved in float stitch patterning. This arrangement has certain restrictions which, on the face of it, are inherent to the invention. Selection for links-links patterning must take place first, and once this is done, the jacks must be kept high. It would seem impossible for any selection to be made later which would require raising jacks to the level of those previously involved in links-links selection or, if this were done, the tracks for the upper butts of the jacks would meet and the jacks for rib and plain stitches would become mixed up and cease to be segregated.

SUMMARY OF THE INVENTION

The present invention is an improvement on that of the British Pat. No. 844,602. It is a purpose of the invention to provide a combined links-links and float stitch or similar patterning arrangement which has the same safety characteristics but which permits the raising of jacks to a high level after links-links selection. It is also a purpose of the invention to provide an arrangement permitting selection of float stitches for a pair of yarn feeds at split levels. It has surprisingly been found that rows of jacks moving peripherally towards a knitting station at different levels, could be moved vertically in opposite directions past each other whilst retaining separate control over each row. Crossing-over of jacks in this fashion makes it possible to raise plain needles above clearing height after other needles have been transferred to the upper cylinder. Three colour jacquard fabrics also including links-links patterning may be made using less pattern drum positions. Consequently, it can be done on machines of small diameter.

The invention relates to circular knitting machinery, and is especially concerned with the arrangements of cams and jacks for patterning.

The invention provides a circular knitting machine comprising a needle cylinder, jacks having a pair of butts rockable to project either one of the butts and slidable in tricks in the cylinder for controlling needles, a selection mechanism and cams for displacing jacks to desired levels along the tricks, in which the cams define a first guide track with a means for rocking the jacks whose butts travel along the track, at an interruption in the track so that their other butts project into a continuation of the track off-set in the direction of the tricks, and a second guide track for butts of other jacks passing through the interruption.

The needles may have a recess for receiving a jack but preferably the invention is applied to superimposed cylinder knitting machines in which the needles are controlled through sliders and the jacks act endwise on sliders. Preferably a pair of superimposed cylinders are provided and one track is adapted to cause needles to be transferred from one cylinder to the other and the other track is adapted to cause needles to be lifted above clearing height (preferably after transfer of needles to the other cylinder) to non-knit at a following knitting station but knit at a subsequent knitting station. Advantageously a further interruption is provided subsequent to the continuation of the first guide track with further means for rocking the jacks travelling along the first track and the second guide track passes back through the further interruption. Conveniently a split pattern drum is provided having a first section to select jacks for transferring needles to the opposite cylinder (for example for links-links patterning) and a second section to select immediately thereafter jacks causing needles to travel along anyone of a number of separate paths (for example for jacquard patterning) and the selection mechanism includes selectors slidable in the tricks and engageable with the jacks to cause a butt of the jack to project and to travel along a track for the butts of inactive jacks, while jacks whose butts are not so engaged travel along a different path from the inactive jacks, their butts being engaged by the first and second guide tracks. It should be understood that the invention covers the arrangement shown where a continuous track raises needles above clearing height as well as the converse arrangement where an interrupted track raises the needles above clearing height.

In knitting machines having superposed needle cylinders and double ended needles, the crossing over of jacks makes it possible to achieve a number of desirable effects. Three colour jacquards combined with links-links patterning may be obtained with the use of three pattern drum positions instead of the four positions previously required. Multi-colour jacquards can be made consequently on machines of small diameter because the number of pattern drum positions can be reduced and the pattern drums be placed closely around the needle cylinders. A low number of pattern drums makes for a saving in mechanism. Open work fabric can be produced. Empty sliders may be safely maintained in a high track at a transfer station to be in a position to receive a needle back from the upper cylinder, and also to function as a latch guard in other locations of the cam box.

BRIEF DESCRIPTION OF DRAWING

The invention is illustrated by way of example in the drawing in which.

DESCRIPTION OF PREFERRED EMBODIMENT

Figure 1:
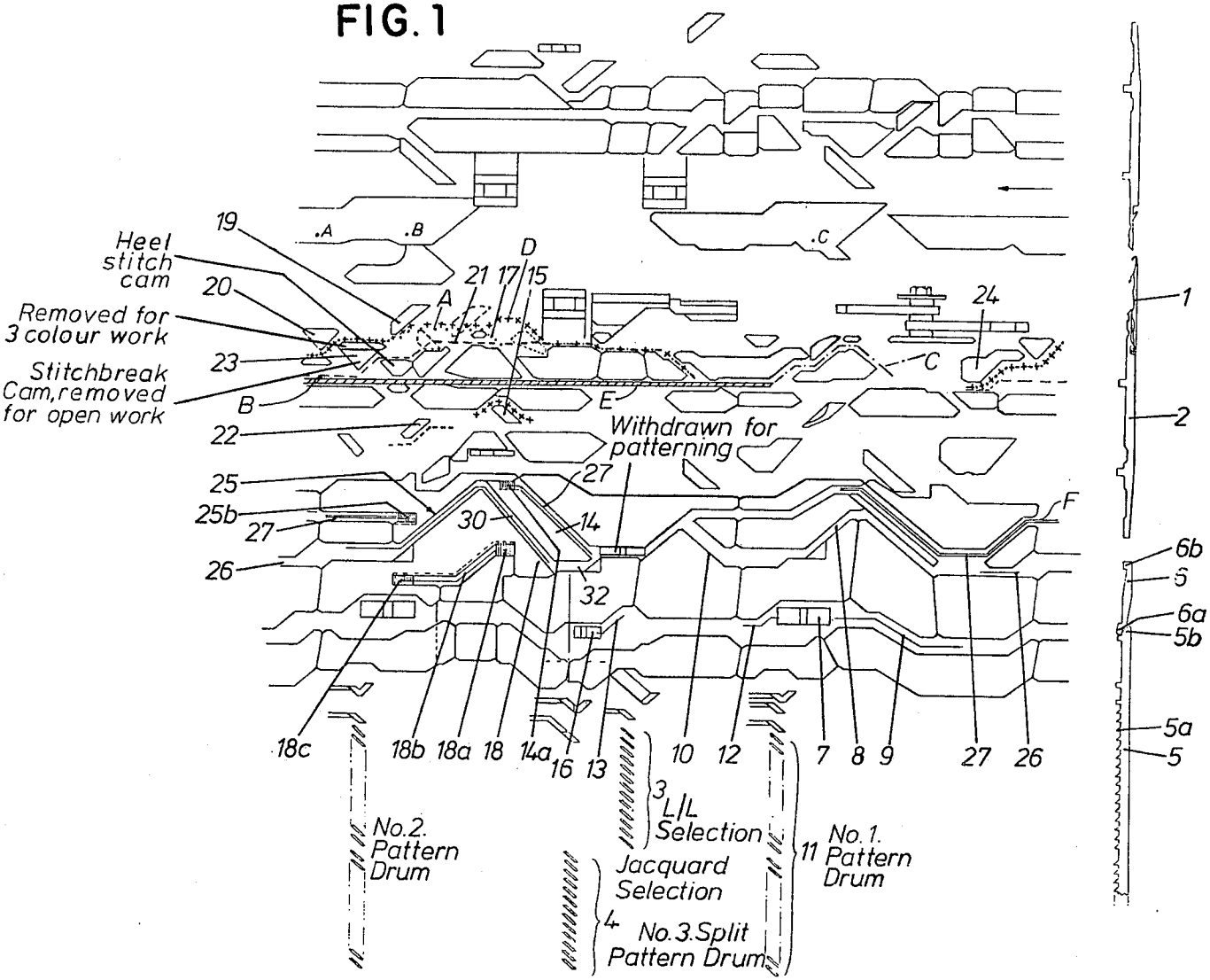
FIG. 1 is a developed view of the inside of a cam box of a circular knitting machine having superposed needle cylinder.

The construction and arrangement of the knitting machine itself is well-known and so will not be further described. The same applies to the majority of the drawing, so the remainder of the description herein is confined to operation for the production of combined jacquard with links-links patterning and open work. The term jacquard patterning is used herein to refer to patterning by selectively providing float stitches. Tuck stitches may also be used for patterning. Different coloured yarns are fed at stations A, B and C. The tracks followed by the knitting butts and in some cases the transfer butts of sliders are identified as follows: Dotted lines ( . . . ) for butts related to needles taking yarn A (line A). Broken lines ( - - - ) for butts related to needles taking yarn B (line B). Chain dotted lines ( - . - . - . ) for butts related to needles taking yarn C (line C).

Lines of crosses (+ + + + +) for butts related to needles transferred to the top cylinder (line D).

Hatched double lines (////) for butts related to needles at inactive level (line E).

Double lines (=) for butts of jacks pursuing a safety track (line F).

Rocking jacks 6 initiate the upward movement of sliders 2 and needles 1 to clear and/or transfer, under the influence of pattern selectors 5.

No. 1 Pattern Drum selected needles required to knit at feeders A and B.

No. 3 Pattern Drum is split into an upper section and a lower section and the upper section controls selector levers 3 which select for transferring needles to the upper cylinder for links-links patterns. The lower section controls selector levers 4 which cause a further selection from the needles already selected by the No. 1 Pattern Drum and divides them into needles which are lowered early enough to take yarn B and needles which are lowered late enough to take yarn A.

No. 2 Pattern Drum selects needles required to knit at feeder C.

The pattern drums initiate a needle movement in the following manner. If the drum allows a selector lever (cam) such as 3 to move in towards the cylinder, a butt 5*a* of a selector 5 will travel up the selector lever cam and the inclined head 5*b* of the selector will contact the rocking jack 6. This contact will cause a lower butt 6*a* of the jack to be projected from the cylinder and the jack rocked so that an upper butt 6*b* is withdrawn into the cylinder trick. To cause the reverse rocking of the jacks 6 so that the upper butt is projected, tipping cams 7 are provided to push the lower butt 6*a* into the cylinder trick.

The direction of rotary knitting is from right to left. Individual jacks 6 or groups of jacks associated with needles which are to knit at feeder C will be travelling down a track 8 (butt 6*b* projected and butt 6*a* depressed). Jacks 6 whose needles are not knitting at feeder C will be travelling in a track 9 (butt 6*a* projected). The tipping cam 7 will depress butts 6*a* into the trick and therefore, just prior to the No. 1 pattern drum selecting station, all the jack butts 6*a* associated with needles knitting in the lower cylinder will be depressed by the cam 7 within their tricks ready for re-selection by the No. 1 pattern drum into groups (a) and (b) as follows:

a. The jacks 6 of those needles which are required to knit at stations A and B and also jacks of needles which are to be transferred to the upper cylinder to knit in due course where necessary a rib stitch at station A are allowed to pass by the No. 1 pattern drum with their butts 6*b* projected so that they will pass up a cam 10 and lift their sliders 2 so that their knitting butts follow track 21 thus bringing their needles to clearing height.

b. A first group of jacks of those needles which are to miss the yarns at stations A and B are rocked at the No. 1 pattern drum by their selectors 5 (butts 5*a* riding up inserted selector cams 11) so that their butts 6*a* will be projected so that they follow a track 12. As a result the associated sliders follow line E.

The jacks of group (a) are now re-selected by the upper part of the No. 3 pattern drum by chosen selector cams 3 causing selectors 5 to rock certain jacks so that their lower butts 6*a* are projected thus causing these jacks to follow a track 13. The sliders above these jacks will continue undisturbed, their butts remaining in track 21 thus maintaining their associated needles in the lower cylinder whereas a second group jacks whose upper butts 6*b* were allowed to remain projected will pass up a cam 14 and cause their associated sliders 2 to be raised by a transfer cam 15 (see line D) thus transferring their needles to the upper cylinder.

The jacks of group (a) which were rocked by the action of their selectors 5 riding up cams 3 (associated with the upper part of No. 3 pattern drum) and whose lower butts 6*a* followed the track 13, are rocked by tipping cam 16 so that they can be subjected to a further selection by the cams 4 associated with the lower part of the No. 3 pattern drum. This further selection determines which of the needles of group (a) (which were raised to clearing height) will take yarn early at feeding station B and which of the needles will take yarn late at feeding station A.

Those needles which are required to take the yarn at A are raised above the needles which are to take the yarn at B. To this end, a third group of jacks under the needles required to take yarn at A are not rocked by their selectors 5 as they pass by the selector cams 4, and therefore their upper butts 6*b* pass up a cam 18 along a track 30. This cam raises the jacks and they raise their associated sliders so that their knitting butts follow a line 17, thus delivering them into a track indicated by line A and their associated needle hooks pass above the yarn at station B. It should be noted that the jacks and not the sliders are the cause of the upward movement of the needles. These needles are eventually lowered to take yarn at A by their sliders being lowered by cams 19 and 20. The remaining sliders (whose jacks herein referred to as a fourth group of jacks, are rocked by their selectors 5 and selected cams 4) are not so lifted and pass along a track 21 (see line B). They are subsequently lowered by their transfer butts contacting a cam 22 so that their knitting butts contact the cam 23 and cause their associated needles to take the yarn fed at station B. The needles which take yarns A or B all complete their knitting action through the knitting butt of their sliders passing down the common stitch cam 24.

From the foregoing description it will be appreciated that in order to obtain the necessary separation of sliders 2, just prior to the main knitting station, so that their associated needles can take either of the yarns A or B, it has been necessary to divert certain sliders and their needles to the extraordinarily high level indicated as track A. The means for diverting the sliders to the high level must be selective and therefore must be under the control of the patterning mechanism. This necessitates the inclusion of the extra track provided by cam slope 18. In order to present the sliders at the high level, it is necessary to make the slope 18 reach the same height as the slope of cam 14 which is used to cause transfer of needles from the bottom cylinder to the top cylinder. However, the inclusion of the new slope 18 causes a problem because the jacks 6 which use the new track must be returned to a low level for re-selection, whereas the jacks which follow the (transfer) slope 14 must not thereafter be directed to the same low level because they would not then be available to position their associated empty sliders at a height suitable for receiving their needles back again from the top cylinder. These jacks must be directed to a 'safety' track 27 after travelling up the cam slope 14.

According to the invention, the problem is overcome by the arrangement of cams shown, and specifically by providing the ramps **14*a* and 25*b* and the auxiliary track 18*b* with ramps 18*a* and 18*c*. The track 27 followed by the (transferring) jack butts 6*b* up and over the cam 14 is interrupted by a ramp 14*a* which rocks the jack so that its lower butt 6*a* is projected into an oppositely sloped ramp 18*a* leading into a track 18*b* which is spaced in a trick-wise direction by the distance between the butts 6*a* and 6*b*. The track 18*b* leads to a further ramp 18*c* which causes rocking of the jack 6 back to its former position with its upper butt 6*b* projecting into an accommodating ramp 25*b* leading into a track which forms part of the safety track 27. The jack 6 has thus performed a see-saw like motion to cross over the track formed by a cam 25. The upper butt 6*b* of the jack 6 then follows the track 27.**

Figure 2:
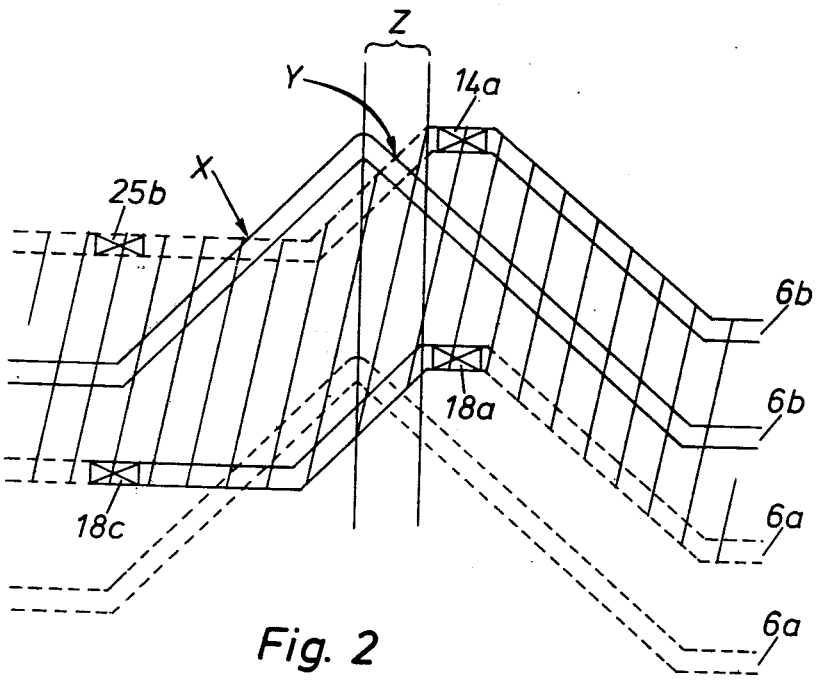
FIG. 2 is a schematic view illustrating the cross-over movement of the jacks.

The see-saw cross-over movement of the jacks has been illustrated schematically in FIG. 2. FIG. 2 shows the tracks followed, in operation of the knitting machine, by the upper butts **6*b* and the lower butts 6*a* of the jacks 6 involved in the transfer of needles to the top cylinder, and those involved in raising needles to the extraordinarily high level. The jacks 6 involved in needle transfer sweep a path which has shaded with diagonal lines and which is defined above and below by the trails of the butts 6*a* and 6*b* associated with those jacks 6. The jacks 6 involved in raising needles to an extraordinarily high level sweep a path which is not shaded. It can be seen in FIG. 2 that the jack paths overlap and move in opposite axial directions in the sector marked Z. The jack paths coincide temporarily at the position marked Y so that briefly the jacks involved in raising needles to an extraordinarily high level rise to the uppermost level. These jacks are then lowered and the jack paths intersect again at the position marked X so that the jacks involved in transfer are once again uppermost and free to remain at a high level. The jacks 6 are enabled to follow their overlapping, intersecting paths —established by using selection only and without requiring differences in the jacks themselves— by rocking the jacks 6. The trails of the butts 6*a* and 6*b* are indicated in solid and dotted lines depending on whether a butt is protruding into a cam track and operative to control the jack path or retracted and inoperative in controlling the jack path. Additionally the dotted lines indicate the absence of a cam track portion. FIG. 2 illustrates how the ramp 14*a* switches control from the butts 6*b* to the butts 6*a* of the jacks 6 involved in needle transfer so as to enable the trail of the projected butts 6*b* of the jacks 6 involved in raising needles to an extraordinarily high level to pass through the trail of the butts 6*b* of the jacks involved in the needle transfer at the location Y without the jacks 6** following the different trails becoming intermingled.

The ramps **14*a* and 18*a* are spaced in a trick-wise direction by the distance between the butts 6*a* and 6*b* which are alternatively projectable from the tricks so that either one or the other can engage a cam track. The butts 6*a* and 6*b* of the jacks following a particular path form parallel trails. In sector Z the cam tracks are slopped in opposite directions and move from a distance (measured in a trick-wise direction) smaller than the distance between the butts 6*a* and 6*b* to a distance greater than that. The upper track then remains at the greater spacing and then again at X moves to a distance from the lower track for the butts 6*a* less than the distance between the butts 6*a* and 6*b* whereafter the ramps 18*c*** rocks the appropriate jacks back into their original attitude. Thus the jack trails can cross-over whilst retaining specific control over the jacks in the separate paths.

Open work fabric can be knitted by making the following simple changes. A cam 23 at the main yarn feeding station is removed so that the sliders following track 21 are allowed to join sliders of track 17 as they pass under the feed cam 20. Thus, if a filament yarn is fed at station A and a heavier yarn at station B, selected needles can be made to take the filament yarn only while other needles take both the heavier yarn and the filament yarn.

I claim:

1. Circular knitting machine comprising a cylinder, tricks in the cylinder, rockable jacks in the tricks, a butt at each end of the rockable jacks, the butts at each end of the individual jacks being alternatively projectable from the tricks by rocking of the jacks, selection means and cam means for sliding a first group of rockable jacks in the tricks and for sliding a second group of the jacks differently from the first group, the cam means defining a first track portion ending at a first position, a second portion starting at a second position spaced in a trick-wise direction from said first position by the distance between the alternatively projectable butts, first means for rocking those individual jacks having alternatively projectable butts at the first and second position, and the cam means further defining a third track portion passing between the first and second positions.

2. Circular knitting machine as claimed in claim 1, wherein the second track portion has an end at a third position and the cam means further define a fourth track portion starting at a fourth position spaced in a trick-wise direction from said third position by the distance between the alternatively projectable butts, second means for rocking those individual jacks having alternatively projectable butts at the third and fourth positions, the cam means defining the third track portion to extend between the first and second to between the third and fourth positions.

3. Circular knitting machine as claimed in claim 2, wherein the third track portion has a part spaced trick-wise from the second track portion by a distance greater than the distance between alternatively projectable butts of the jacks.

4. Circular knitting machine as claimed in claim 1, wherein the cam means have a sector wherein the second and third track portions are inclined in opposite directions and are disposed in that sector between locations at a trick-wise distance greater than the distance between alternatively projectable butts and locations at a trick-wise distance smaller than the distance between alternatively projectable butts.

5. Circular knitting machine as claimed in claim 1, in which the first means for rocking the individual jacks consist of a ramp aligned with the lengthwise direction of the first track portion.

6. Circular knitting machine as claimed in claim 1, wherein the selection means include selectors slidable in the tricks and engageable with the jacks to project that one of the alternatively projectable butts which is adjacent to the selectors.

7. Circular knitting machine as claimed in claim 1, wherein the cam means further include a further track portion for receiving a lower one of the alternatively projectable butts of a third group of jacks, and the selection means is adapted to dispose an upper butt of the alternatively projectable butts of the first and second group of jacks in the first and third track portion.

8. Circular knitting machine comprising a pair of superimposed cylinders, tricks in the cylinders, sliders in the tricks for engaging double ended needles, rockable jacks in the tricks of one cylinder associated with the sliders in that cylinder, a butt at each end of the rockable jacks, the butts at each end of the individual jacks being alternatively projectable from tricks by rocking of the jacks, selection means and cam means for controlling a first group of rockable jacks to leave associated sliders at a non-knitting level, a second group of rockable jacks to bring associated sliders to a needle transfer level, a third group of rockable jacks to bring associated sliders to a level above clearing height, and a fourth group of rockable jacks to bring associated sliders to a knitting level, said cam means defining a first track portion ending at a first position, a second track portion starting at a second position spaced in a trick-wise direction from said first position by the distance between the alternatively projectable butts, first means for rocking those individual jacks having alternatively projectable butts at the first and second position so as to bring the sliders associated with the second group of jacks to the needle transfer level, said cam means further defining a third track portion passing between the first and second position so as to bring sliders associated with the third group of jacks to the level above clearing height after passing the needle transfer zone.

9. Circular knitting machine as claimed in claim 8, wherein the second track portion has an end at a third position and the cam means further define a fourth track portion starting at a fourth position spaced in a trick-wise direction from said third position by the distance between the alternatively projectable butts, second means for rocking those individual jacks having alternatively projectable butts at the third and fourth positions, the cam means defining the third track portion to extend from between the first and second to between the third and fourth positions so as to lower the third group of jacks after raising the associated sliders to the level above clearing height to below the second group of jacks.

10. Circular knitting machine as claimed in claim 8, wherein the cam means further include a further track portion for receiving a lower one of the alternatively projectable butts of the fourth group of jacks and the selection means is adapted to dispose an upper butt of the alternatively projectable butts of the second and third group of jacks in the first and third track portion.

11. Circular knitting machine as claimed in claim 8, wherein a split pattern drum is provided having a first section for selecting the second group of jacks to follow the first track portion and a third section for selecting the second group of jacks to follow the third track portion.

* * * * *